US005991575A

United States Patent [19]

Okiyama et al.

[11] Patent Number: 5,991,575

[45] Date of Patent: Nov. 23, 1999

[54] BELT UNIT

[75] Inventors: Yoshitatsu Okiyama; Ken Kikuchi, both of Tokyo, Japan

[73] Assignee: OKI Data Corporation, Tokyo, Japan

[21] Appl. No.: 09/306,914

[22] Filed: May 7, 1999

[30] Foreign Application Priority Data

May 12, 1998 [JP] Japan ..... 10-128008

[51] Int. Cl.[6] ..... G03G 15/00

[52] U.S. Cl. ..... 399/165; 198/806

[58] Field of Search ..... 399/165, 303, 399/313; 198/806, 807; 347/154, 153; 474/101, 111, 112

[56] References Cited

U.S. PATENT DOCUMENTS

| | | | |
|---|---|---|---|
| 4,087,169 | 5/1978 | Fantuzzo | 399/313 |
| 4,170,175 | 10/1979 | Conlon, Jr. | 198/806 X |
| 4,174,171 | 11/1979 | Hamaker et al. | 399/165 |
| 4,183,658 | 1/1980 | Winthaegen | 399/165 |
| 4,626,095 | 12/1986 | Berger | 399/165 |
| 5,343,279 | 8/1994 | Nagata et al. | 198/806 X |
| 5,481,338 | 1/1996 | Todome | 198/806 X |
| 5,659,851 | 8/1997 | Moe et al. | 399/165 |

*Primary Examiner*—Susan S. Y. Lee
*Attorney, Agent, or Firm*—Rabin & Champagne, PC

[57] ABSTRACT

A belt unit has a drive roller, a driven roller, and a tension roller. An endless belt is mounted about the drive roller, driven roller, and tension roller. When the drive roller is driven by a motor, the endless belt runs with a print medium placed thereon. The tension roller longitudinally extends in a direction perpendicular to the direction in which the belt runs. First and second support members are pivotally mounted on a frame and support the tension roller between the first and second supports. The spring urges the support members so that the tension roller exerts tension on the belt. A coupling member such as a rod, wire, and plate couples the first support member to the second support member, so that a first pivotal movement of one of the first and second support members causes a second pivotal movement of the other of the first and second support members, the first and second pivotal movements applying a substantially same urging force to the belt.

8 Claims, 11 Drawing Sheets

BELT UNIT

FIELD OF THE INVENTION

The present invention relates to a belt unit.

DESCRIPTION OF THE RELATED ART

Conventional electrophotographic printers incorporate belt units such as a photoconductive belt, a fixing belt, and a print medium-transporting belt. The belts are driven to run in these belt units. For example, a print medium is advanced by a feeding roller from a paper cassette or the like and directed by transport rollers to a medium-transporting belt, which in turn carries the print medium to a transfer area defined between a photoconductive drum and a transfer roller. A toner image formed on the photoconductive drum is transferred to the print medium as the print medium passes through the transfer area. The print medium is then advanced to a fixing unit where the toner image on the print medium is fixed.

The medium-transporting belt is an endless belt mounted about a drive roller, a driven roller, and an idle roller. The tension of the medium-transporting belt is adjusted by a tension roller. The tension roller is rotatably attached to free end portions of rods that are pivotally supported on a shaft. Springs are mounted to the rods and urge the tension roller against the medium-transporting belt. The tension roller may be directly urged by springs against the belt without using the rod.

If the drive roller and driven roller are supported on a frame with low dimensional accuracy, the alignment i.e., parallelism among the drive roller, driven roller, and idle roller becomes poor, the tension roller cannot properly adjust the tension, or the springs on the both sides of the tension roller apply different tension forces to the medium-transporting belt. Improper tension applied to the medium-transporting belt creates a lateral force that acts on the transporting belt, causing a skew problem.

FIGS. 13A is a fragmentary cross-sectional view of a conventional belt unit.

FIG. 13B is fragmentary perspective view of the conventional belt unit of FIG. 13A.

FIGS. 13C–13D are partially cross-sectional side views of the conventional belt unit of FIG. 13A.

In order to prevent the skew problem, a guide made of, for example, a rubber material is bonded to the inside of the transport belt, the rubber material being disposed at the left and right ends across the width W (FIG. 13A). In addition, longitudinal ends of the tension roller are beveled and the guides formed on the belt abut the beveled surfaces, thereby preventing the transport belt from moving in a direction perpendicular to a direction in which the medium-transporting belt runs.

Too large a lateral force imposes a significant stress on the guide (FIG. 13C), resulting in a skew problem or causing the guide to come off the transport belt (FIG. 13D). Thus, in order to prevent large differences in urging force between the left end and the right end across the width of the medium transporting belt, it is necessary to employ springs that have matched spring characteristics or a combination of springs that have been grouped in different levels of spring characteristics, or to firmly bond the guide to the transport belt. This increases the cost of the belt unit.

Moreover, if the main body of the image forming apparatus is twisted, the positional alignment among the drive roller, driven roller, and idle roller will become improper.

Thus, the overall mechanical rigidity of the image forming apparatus needs to be increased. However, increasing rigidity will also increase the cost of the belt unit.

SUMMARY OF THE INVENTION

The present invention was made to solve the aforementioned problems of the conventional belt unit.

An object of the present invention is to provide a belt unit, which is inexpensive and free from a skew problem.

A belt unit has a rotating drive roller, a rotating driven roller, and a tension roller. An endless belt is mounted about the drive roller and the driven member or driven roller. The driven roller is connected to a motor and driven in rotation. When the drive roller, the endless belt runs with a print medium placed thereon. The tension roller longitudinally extends in a direction perpendicular to the direction in which the belt runs, and exerts tension on the belt so that the belt run under tension. First and second support members are pivotally mounted a frame and support the tension member between the first and second supports. An urging member such as a spring urges the tension roller against the belt through the support members. A coupling member such as a rod, wire, and plate couples the first support member to the second support member, so that that a first pivotal movement of one of the first and second support members causes a second pivotal movement of the other of the first and second support members, the first and second pivotal movements applying a substantially same urging force to the belt.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

Preferred embodiments of the present invention will be described in detail with reference to the accompanying drawings.

First Embodiment

<Construction>

Figure 1:
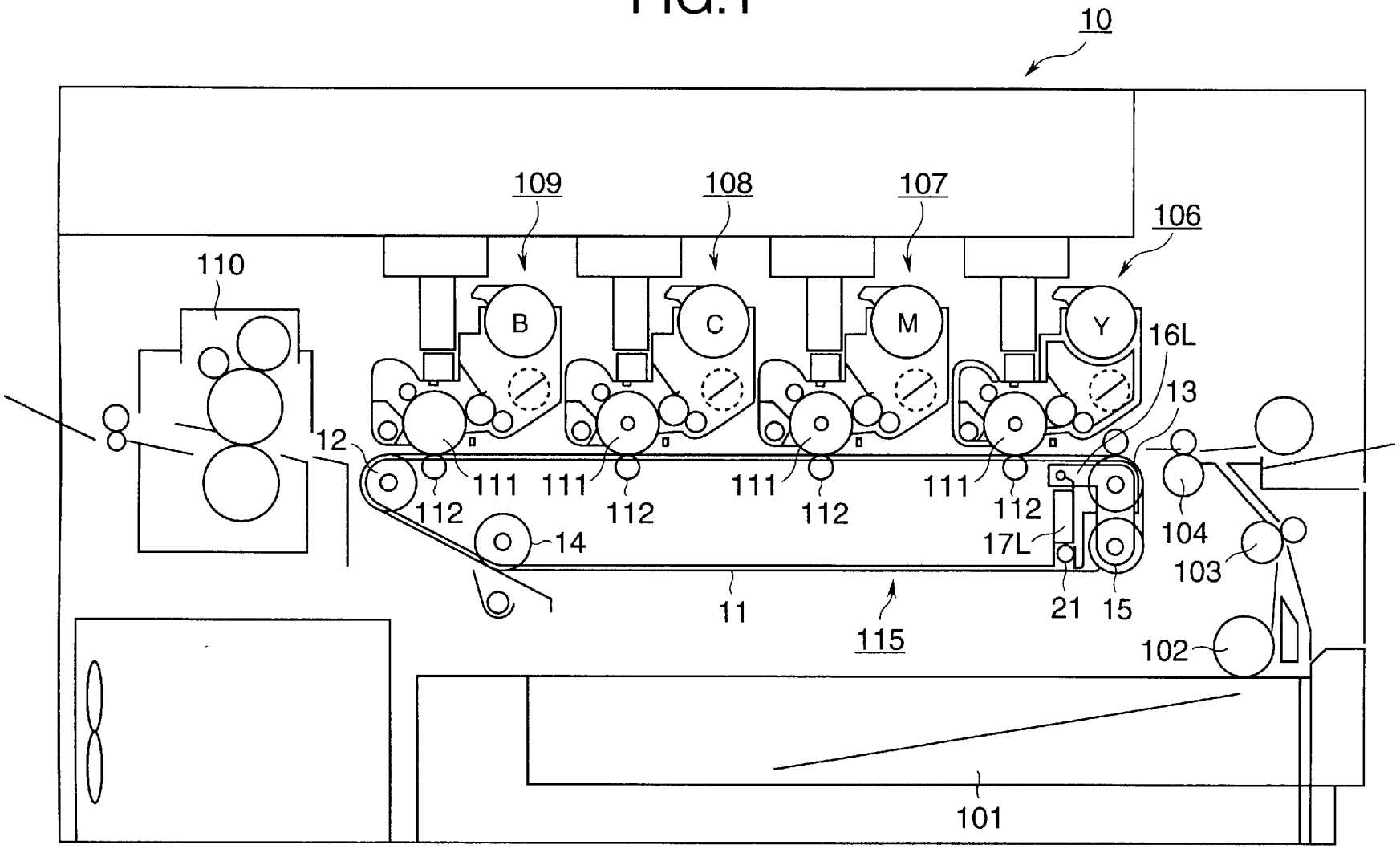
FIG. 1 illustrates a general construction of an image recording apparatus to which a belt unit of the present invention is applied.

FIG. 1 illustrates a general construction of an image recording apparatus to which a belt unit of the present invention is applied.

Referring to FIG. 1, an endless transport belt 11 runs in an image recording apparatus 10. A print medium or paper, not shown, is advanced by a feed roller 102 from a paper cassette 101 to transport rollers 103 and 104, which in turn feed the print medium to the transport belt 11. Image forming units 106–109 for yellow, magenta, cyan, and black images are disposed in this order in a direction in which the transport belt 11 runs. The transport belt 11 is sandwiched between photoconductive drums 111 and transfer rollers 112 of the respective image forming units 106–109.

Yellow, magenta, cyan, and black toner images formed on the photoconductive drums 111 are transferred to the print medium in registration with one another as the print medium passes through the respective image forming units 106–109. The print medium subsequently feeds from the transport belt 11 to a fixing unit 110 where the toner images of the respective colors are fixed into a full color image.

Figure 2:
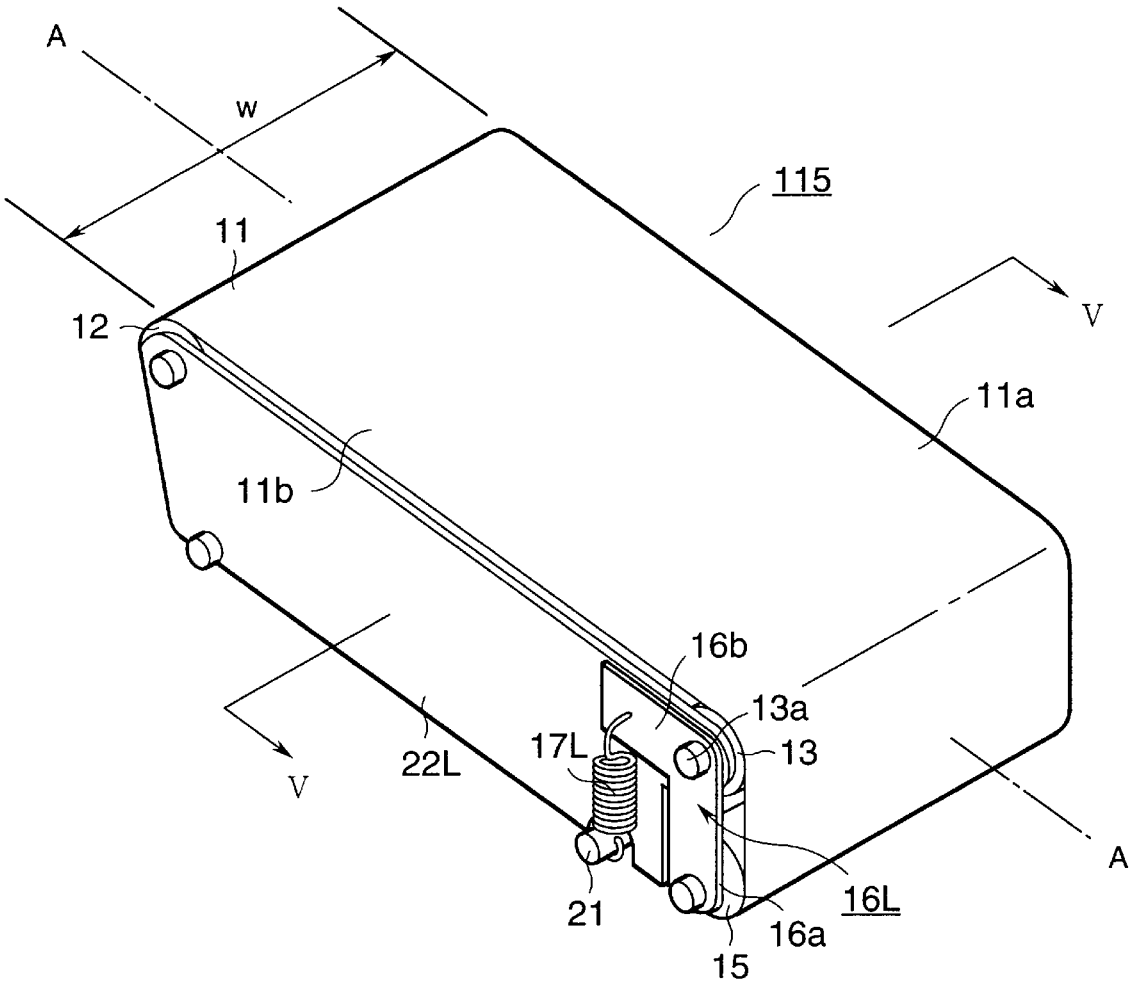
FIG. 2 is a perspective view of a belt unit according to a first embodiment of the present invention.

FIG. 2 is a perspective view of a belt unit 115 of the present invention.

Figure 3:
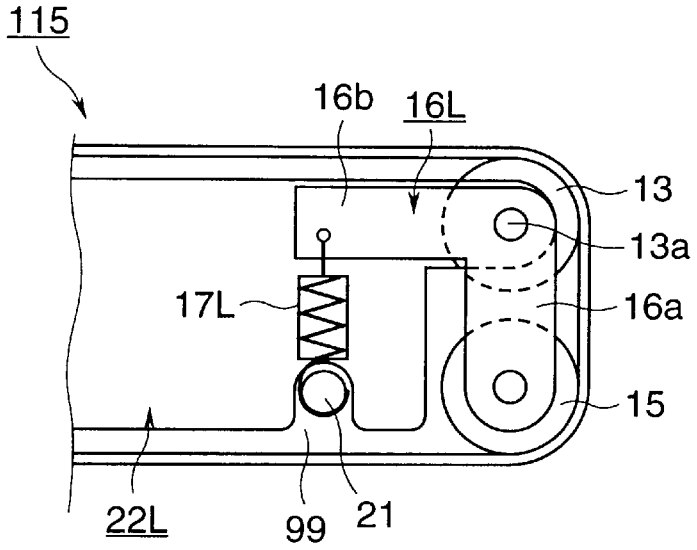
FIG. 3 is a fragmentary side view of a left end portion of the belt unit of FIG. 2.

FIG. 3 is a fragmentary side view of a left end portion of the belt unit of FIG. 2.

Figure 4:
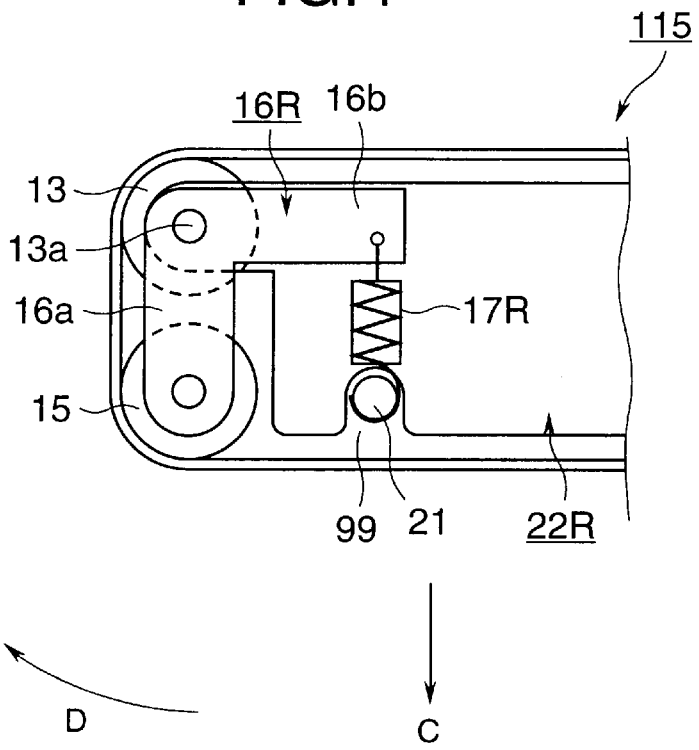
FIG. 4 is a fragmentary side view of a right end portion of the belt unit of FIG. 2.

FIG. 4 is a fragmentary side view of a right end portion of the belt unit of FIG. 2.

Figure 5:
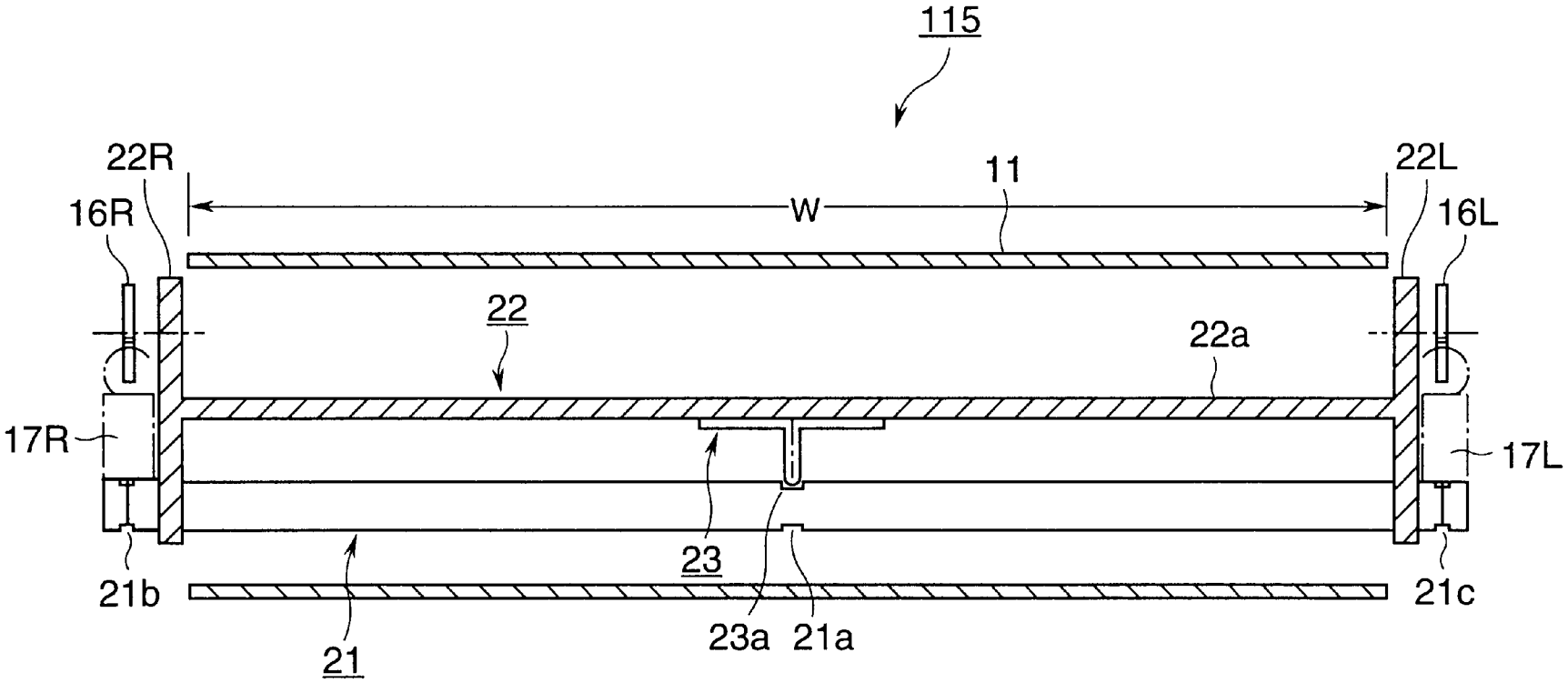
FIG. 5 is a transverse cross-sectional view taken along lines V—V of FIG. 2.

Referring to FIGS. 2–4, a drive roller 12, driven roller 13, and idle rollers 14 are rotatably supported on the vertical walls 22L and 22R across a horizontal floor 22*a* of a frame 22 (FIG. 5). The transport belt 11 is mounted about the drive roller 12, driven roller 13, idle roller 14, and tension roller 15. The drive roller 12 is driven in rotation by a drive motor, not shown, thereby causing the transport belt 11 to run.

L-shaped tension arms 16L and 16R are mounted to longitudinal ends of the driven roller 13 and pivot about a rotational shaft 13*a* of the driven roller 13. Each of the tension arms 16L and 16R has arms 16*a* and 16*b* which are substantially at right angle with each other. A tension roller 15 is rotatably supported at its longitudinal ends on free end portions of the arms 16*a* of the tension arms 16L and 16R.

FIG. 5 is a transverse cross-sectional view taken along lines II—II of FIG. 2.

Referring to FIG. 5, the frame 22 has a generally H-shaped cross section and includes the horizontal floor 22*a* and vertical walls 22L and 22R. The vertical walls 21L and 21R are symmetrically disposed with respect to a longitudinal axis A—A (FIG. 2) of the belt unit.

A shaft 21 laterally extending through the vertical walls 22L and 22R of the frame 22. The shaft 21 has circumferential grooves 21*b* and 21*c* formed at longitudinal end portions thereof. The springs 17L and 17R are mounted between the arms 16 and the shaft 21 such that one ends of the springs 17L and 17R are received in the grooves 21*b* and 21*c*, respectively, and the other ends are coupled to the free end portions of the arms 16*b*. Thus, the springs 17L and 17R urge the tension roller 15 against the transport belt 11 so that the transport belt 11 is mounted under tension about the drive roller 12, driven roller 13, and tension roller 15.

The transport belt 11, drive roller 12, driven roller 13, tension roller 15, tension arms 16L and 16R, springs 17L and 17R, and shaft 21 form a belt unit according to the present invention.

A fulcrum member 23 is fixedly disposed on an underside of the horizontal floor 22*a* and laterally in the middle of the horizontal floor 22*a*. The shaft 21 pivotally engages the fulcrum member 23 with a vertical end 23*a* received in a circumferential groove 21*a* formed in the longitudinal direction substantially in middle of the shaft 21. When the vertical end 23*a* is received in the groove 21*a*, the shaft 21 is positioned in the longitudinal direction relative to the belt frame 22. The shaft 21 extends loosely through cutouts 99 formed in the vertical walls 22L and 22R. The cutouts 99 extend vertically, allowing the shaft 21 to move only in the vertical direction.

<Operation>

The operation of the belt unit 115 of the aforementioned construction will be described.

The tension roller 15 is urged against the inside of the transport belt 11. If any one of the drive roller 12, driven roller 13, and idle roller 14 is not properly aligned in its position and direction of rotational axis with respect to the others, or the peripheral length of the transport belt 11 varies across the width W, the tension roller 15 tilts relative to the axis of the driven roller 13, accordingly.

Thus, the tension arms 16L and 16R on which the tension roller 15 is supported are at different angular positions with respect to the shaft 13*a*.

Figure 6:
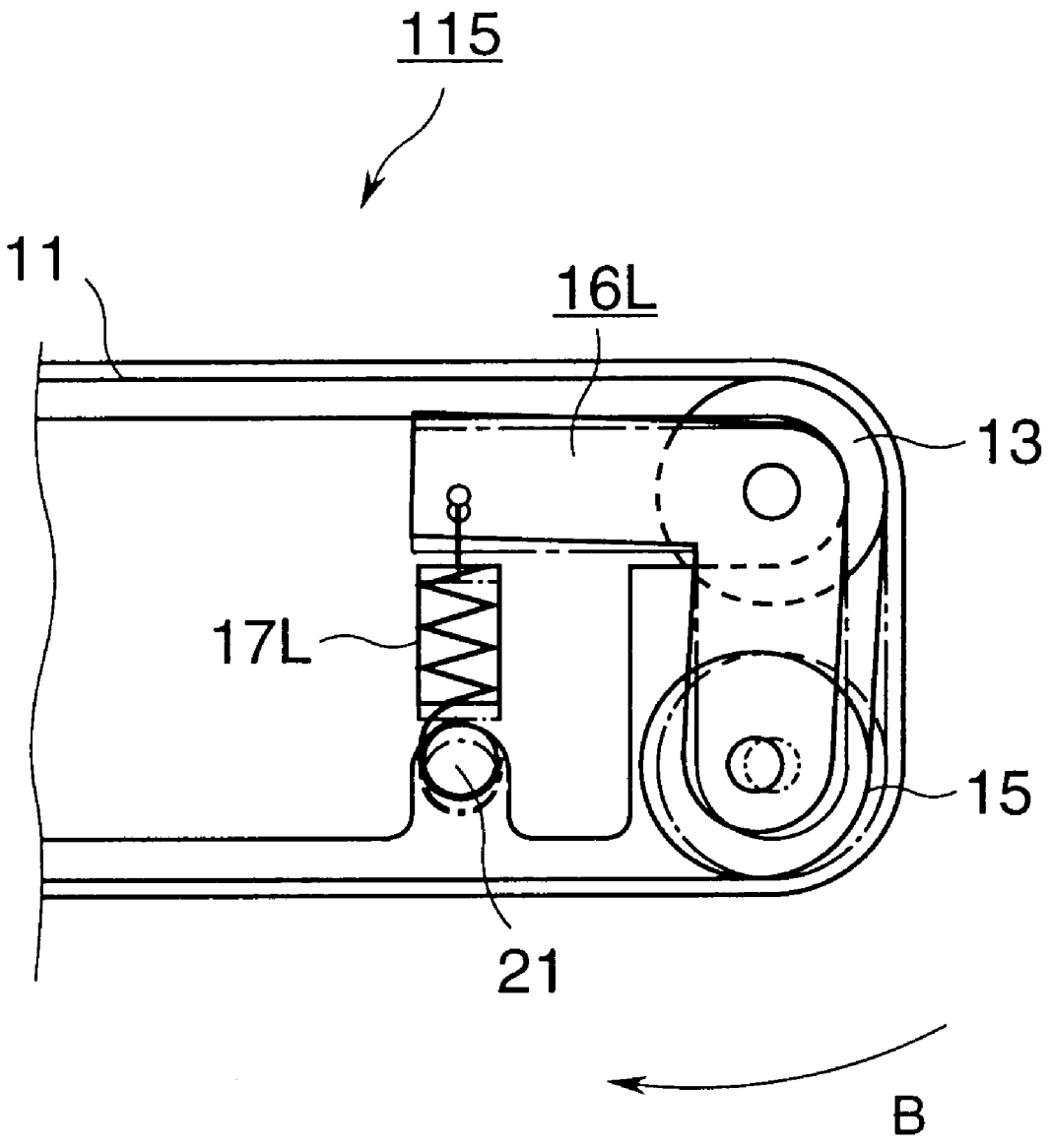
FIG. 6 is a fragmentary side view showing the left end portion of the belt unit.

The tension arms 16L and 16R are coupled to the ends of the shaft 21 by means of the springs 17L and 17R. Thus, the shaft 21 is rocked with respect to the fulcrum 23*a* in accordance with the tilt of the tension roller 15. For example, if the transport belt 11 has the same peripheral lengths at the left edge and right edge, the tension roller 15 rotates about an axis parallel to the drive roller 12. In other words, the tension roller 15 is at a dot-dash line position as shown in FIG. 6, so that the tension arm 16L is at the same angular position as the tension arm 16R. Thus, the shaft 21 is in parallel with the driven roller 13.

If the peripheral length of a lateral left half 11*b* of the transport belt 11 is shorter than that of a lateral right half 11*a*, the left end of the tension roller 15 is at an inner side of the transport belt 11 than the right end of the tension roller 15, so that the tension arm 16L is at a solid line position in FIG. 6. It is to be noted that the tension arms 16L and 16R are not at the same angular position. The belt 11 pushes the tension roller 15 so that the arm 16L pivots in a direction shown by arrow B, causing the spring 17L to upwardly stretch. Then, the shaft 21 will vertically pivot about the vertical end 23*a* so that the other end of the shaft 21 will cause the spring 17R to stretch in a direction shown by arrow C (FIG. 4). Thus, the arm 16R will pivot about the shaft 13*a* in a direction shown by arrow D (FIG. 4).

In other words, a pivotal movement of one of the first and second support members causes a pivotal movement of the other of the first and second support members, the pivotal movements applying a substantially same urging force to the belt.

As a result, an urging force exerted by the spring 17L on the tension arm 16L is equal to that exerted by the spring 17R on the tension arm 16R.

In other words, a moment developed clockwise with respect to the vertical end 23*a* is equal to that developed counterclockwise.

In this manner, the tension acting on the both lateral ends of the transport belt 11 can be made equal, so that the lateral force will not be exerted on the transport belt 11. As a result, there is no chance of a skew problem occurring, so that the transport belt 11 runs with stability. Moreover, there is no need for bonding a guide made of, for example, a rubber material on the inside of the transporting belt 11 or using the springs 17L and 17R whose urging forces are substantially matched as in the conventional belt unit. The construction of the present invention reduces the manufacturing cost of a belt unit.

The belt frame 22 can be prevented from twisting even if the belt frame 22 is not of a highly rigid structure. The construction of the invention does not need long springs 17L and 17R which provide a smaller spring constant, allowing miniaturizing of a belt unit.

Second Embodiment

Elements similar to those of the first embodiment have been given the same reference numerals and description thereof is omitted.

Figure 7:
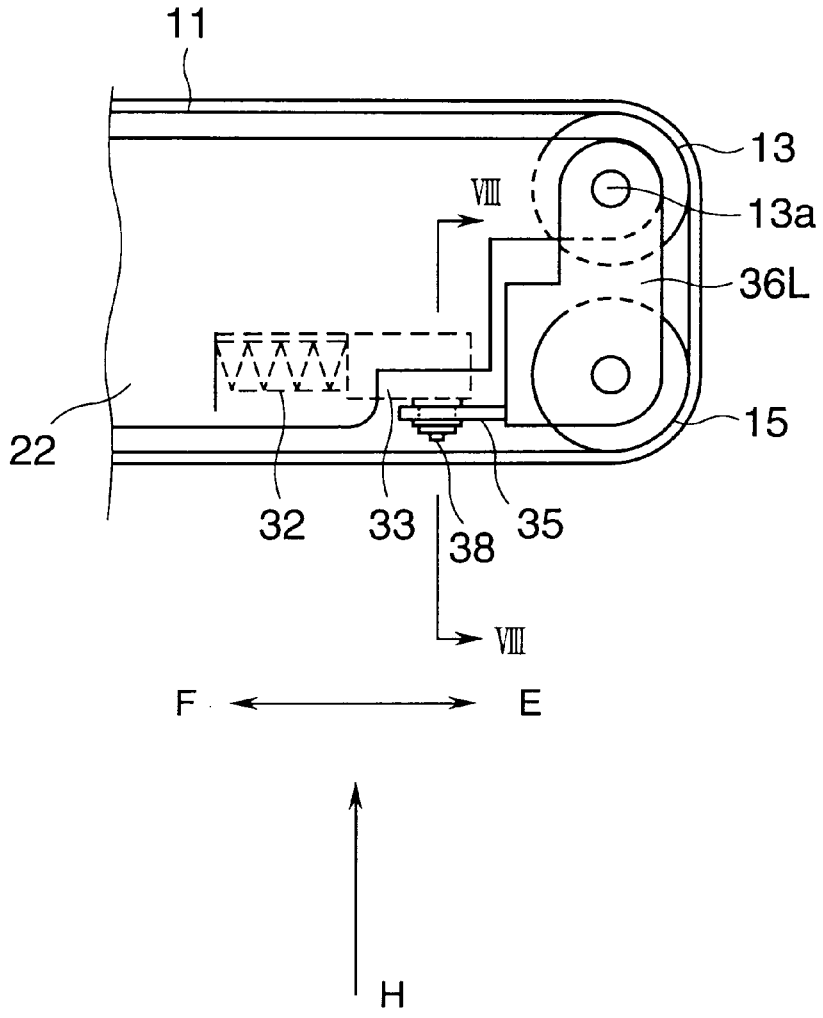
FIG. 7 is a fragmentary left side view of a belt unit according to a second embodiment.

FIG. 7 is a fragmentary left side view of a relevant portion of a belt unit according to a second embodiment.

Figure 8:
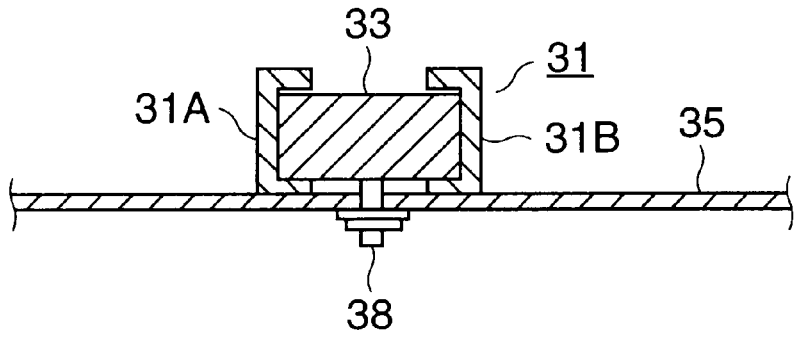
FIG. 8 is a fragmentary partial cross sectional view taken along lines VIII—VIII of FIG. 7.

FIG. 8 is a fragmentary partial cross sectional view taken along lines VIII—VIII of FIG. 7.

Figure 9:
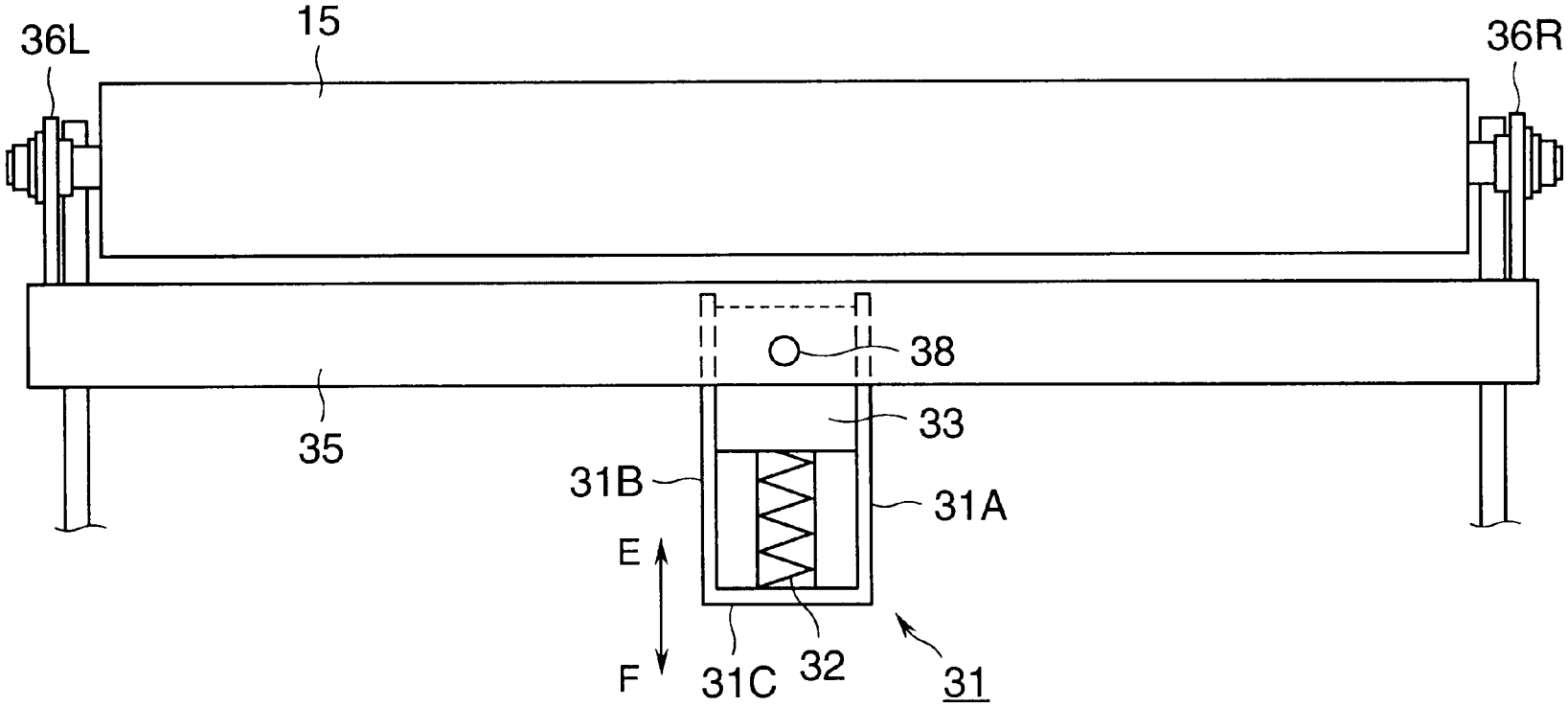
FIG. 9 is a bottom view showing a relevant portion of a belt unit according to the second embodiment.

FIG. 9 is a bottom view of a relevant portion of the belt unit, looking in a direction shown by arrow H of FIG. 7.

Referring to FIGS. 7 and 8, tension arms 36L and 36R are pivotally mounted to the longitudinal ends of the driven roller 13. The tension arms are mounted on the shaft 13*a* of the driven roller 13. The tension roller 15 is supported across the tension arms 36L and 36R and freely rotates.

A generally U-shaped guide 31 is disposed on an underside of the horizontal floor 22*a* of the belt frame 22 in a lateral direction substantially at a center of the horizontal floor 22*a*. The guide 31 includes two opposing slides 31A and 31B and a holding member 31C between the slides 31A and 31B. A pressing piece 33 is slidably held between the slides 31A and 31B of the guide 31. There is provided a compression spring 32 between the pressing piece 33 and the holding element 31*c* of the guide 31.

The pressing piece 33 has a pin 38 via which a pressing plate 35 is pivotally coupled substantially at its longitudinal middle to the pressing piece 33. The pressing piece 33 is urged by the spring 32 in a direction shown by arrow E so that longitudinal end portions of the pressing plate 35 abut the tension arms 36L and 36R. Thus, the tension roller 15 rotates in pressure contact with the transport belt 11.

If any one of the drive roller 12, driven roller 13, and idle roller 14 is not properly aligned in its position and direction of rotational axis with respect to the others, or the peripheral length of the transport belt varies across the width W of the transport belt, the tension roller 15 tilts relative to the axis of the driven roller 13, accordingly.

Thus, the tension arms 16L and 16R on which the tension roller 15 is supported are at different angular positions with respect to the shaft 13*a*.

When the tension arms 16L and 16R take different angular positions, the tension arms 16L and 16R cause the pressing plate 35 to pivot about the pin 38. For example, if the transport belt 11 has the same peripheral lengths at its laterally left and right end portions, the tension roller 15 rotates about an axis parallel to the drive roller 12.

If the peripheral length of laterally left end portion of the transport belt 11 is shorter than that of the right end portion, the left end of the tension roller 15 is at an inner side than the right end of the tension roller. Thus, the tension arms 36L and 36R are not at the same angular position. The transport belt 11 pushes the tension roller 15, which in turn causes the arm 36L to pivot about the pin 13 in a direction shown by arrow F (FIG. 8).

In other words, a moment developed clockwise with respect to the pin 38 is equal to that developed counterclockwise, as shown in FIG. 9.

As a result, the pressing plate 35 is no longer parallel to the tension roller 15. Since the longitudinal end portions of the pressing plate 35 abut the tension arms 36L and 36R, the pressing plate 35 presses the tension arms 36L and 36R with the same urging force.

In this manner, each of the tension arms 36L and 36R receives half the urging force of the spring 32. A single spring serves to urge both the tension arms 36L and 36R, allowing miniaturizing of the belt unit.

Third Embodiment

Figure 10:
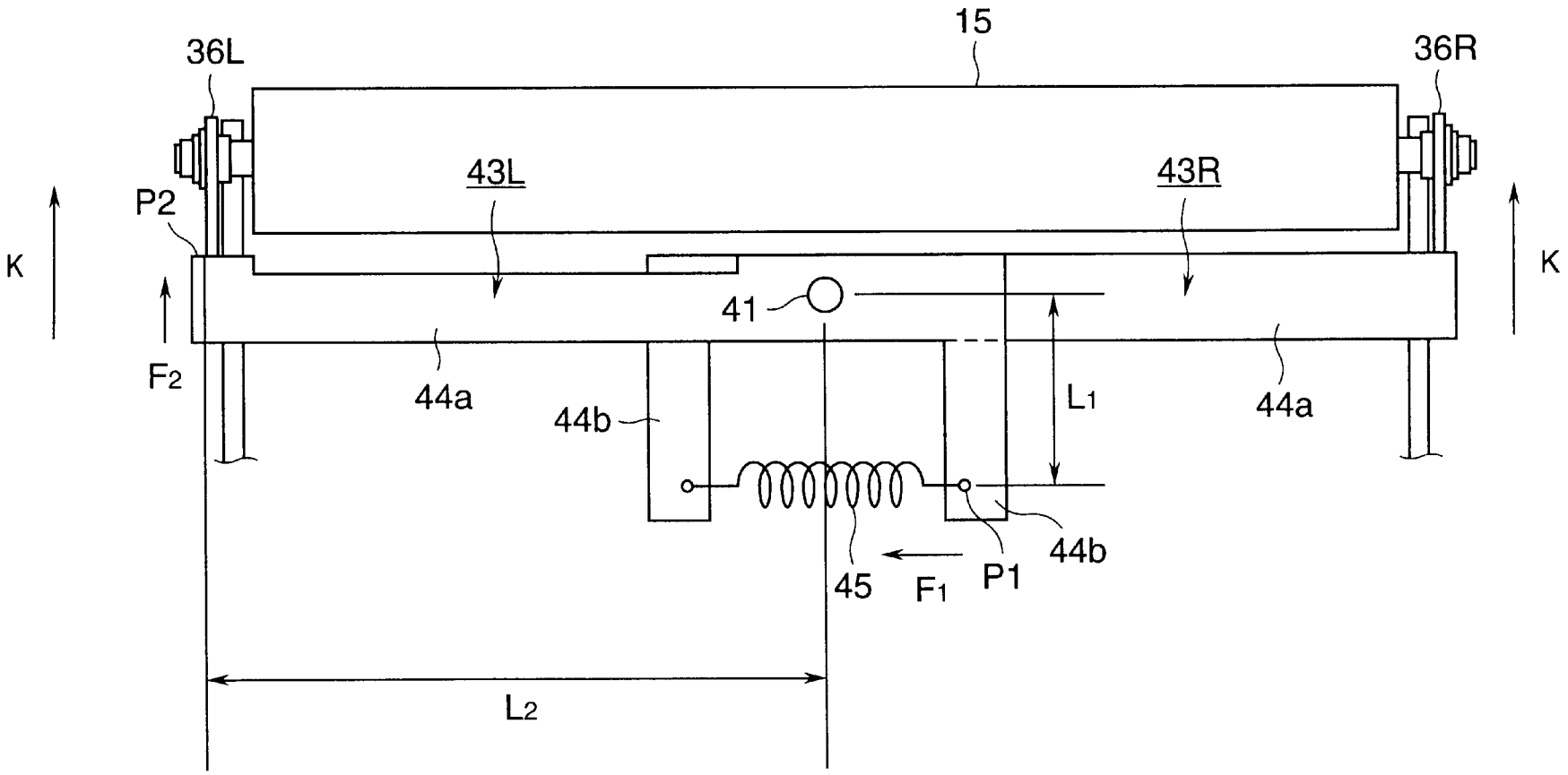
FIG. 10 is a bottom view of a third embodiment.

FIG. 10 is a bottom view showing a relevant portion of a belt unit according to a third embodiment.

Figure 11:
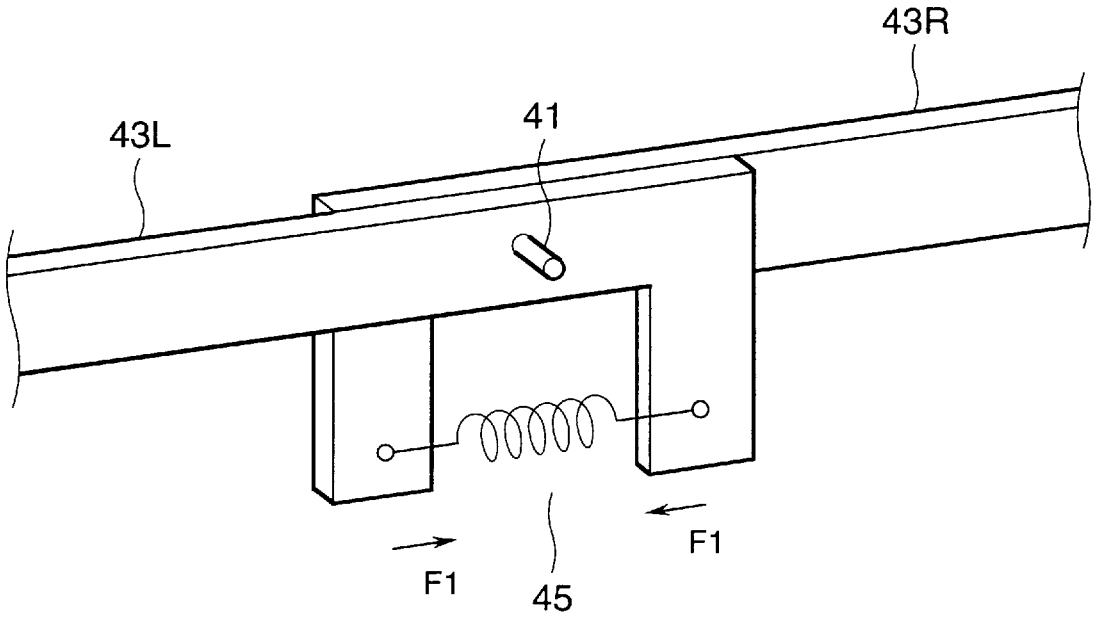
FIG. 11 is a fragmentary perspective view of pressing plates and an urging spring of the third embodiment.

FIG. 11 is a fragmentary perspective view of pressing plates.

The third embodiment differs from the second embodiment in that pressing plates 43L and 43R are used in place of the pressing plate 35 and spring 45 is used in place of the spring 32.

Generally L-shaped tension arms 36L and 36R are mounted to the longitudinal ends of the driven roller 13 (FIG. 7) and are pivotal about the rotational axis of the driven roller 13. The tension roller 15 is rotatably supported across free end portions of the tension arms 36L and 36R. The belt frame 22 (FIG. 5) is provided with a pin 41 that is located in a lateral direction substantially at the center of the belt frame 22 and vertically projects from the belt frame 22. The two L-shaped pressing plates 43L and 43R are pivotally supported by the pin 41 on the belt frame 22*a* and positioned as a mirror image with respect to the pin 41.

Each of the pressing plates 43L and 43R has a long arm 44*a* that extends in a direction perpendicular to a direction in which the transport belt runs, and a short arm 44*b* that extends perpendicular to the tension roller 15. The free end portions of the long arms 44*a* abut the tension arms 36L and 36R, respectively. Mounted between the free end portions of the short arms 44*b* is a tension spring 45 that urges the short arms 44*b* toward each other.

The urging force of the spring 45 causes the longitudinal end portions of the long arms 44*a* to press the tension arms 36L and 36R in the direction shown by arrow K. If any one of the drive roller 12, driven roller 13, and idle roller 14 is not properly aligned in its position and direction of rotational axis with respect to the others, or the peripheral length of the transport belt 11 varies across the width W of the transport belt, the tension roller 15 tilts relative to the axis of the driven roller 13, accordingly.

Thus, the tension arms 36L and 36R on which the tension roller 15 is supported are at different angular positions with respect to the shaft 13*a*.

For example, if the lateral left and right halves of the transport belt 11 has the same peripheral length, the tension roller 15 rotates about an axis parallel to the drive roller 12 and therefore the long arms 44*a* of the pressing plates 43L and 43R are parallel to the driven roller 13.

If the peripheral length of lateral left half of the transport belt 11 is shorter than that of the lateral right half, the left end of the tension roller 15 is at an inner side than the right end of the tension roller 15, so that the tension arms 36L and 36R are at different angular positions. Thus, the transport belt 11 pushes the tension roller 15 in a direction opposite to the direction shown by arrow K. The tension roller 15 in turn causes the arm 36L to pivot in a direction opposite to the direction shown by arrow K. As a result, the long arms 44*a* of the pressing plates 43L and 43R are no longer parallel to the tension roller 15.

Since the longitudinal end portions of the pressing plates 44L and 44R abut the tension arms 36L and 36R, the pressing plates 44L and 44R presses the tension arms 36L and 36R with the same urging force.

In other words, a moment developed clockwise with respect to the pin 41 is equal to that developed counter-clockwise. Thus, each of the tension arms 36L and 36R receives half the total resultant urging force of the spring 45.

A single spring serves to urge both the tension arms 36L and 36R, allowing miniaturizing of the belt unit.

Referring to FIG. 10, there is the following relation.

$$F1 \cdot L1 = F2 \cdot L2 \qquad \text{Equation (1)}$$

therefore, $F1=(F2 \cdot L2)/L1$ where P1 is a point at which the spring 45 urges the short arm 44*b*, P2 is a point at which the pressing plate 43L presses the tension arm 36L, L1 is a distance between the pin 41 and point P1, L2 is a distance between the pin 41 and point P2, F1 is an urging force of the spring 45 acting on point P1, and F2 is an urging force that the pressing plate 43L applies to the tension arm 36L.

The magnitude of the force F2 can be adjusted by carefully selecting the length (i.e., distance L1) of the short arms 44*b*.

Fourth Embodiment

Figure 12:
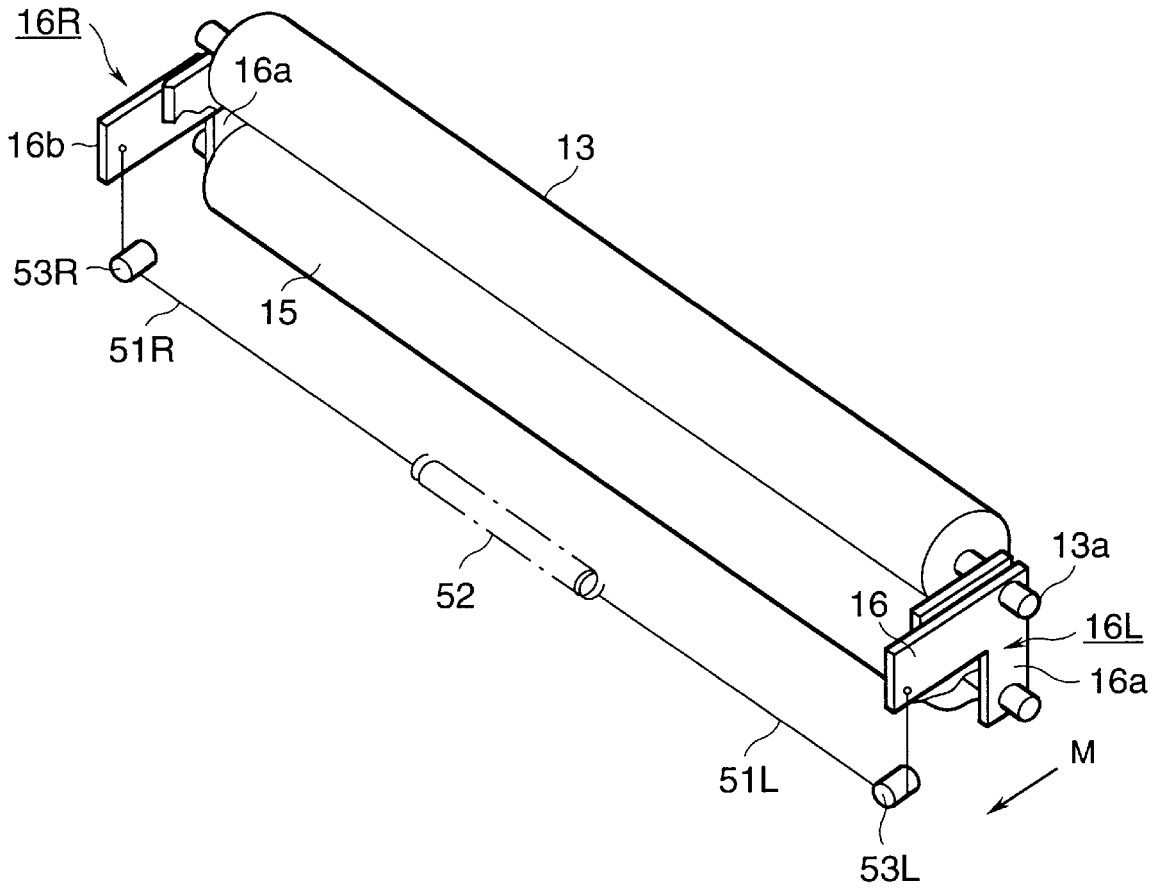
FIG. 12 is a perspective view of a belt unit according to a fourth embodiment.
Figure 13A:
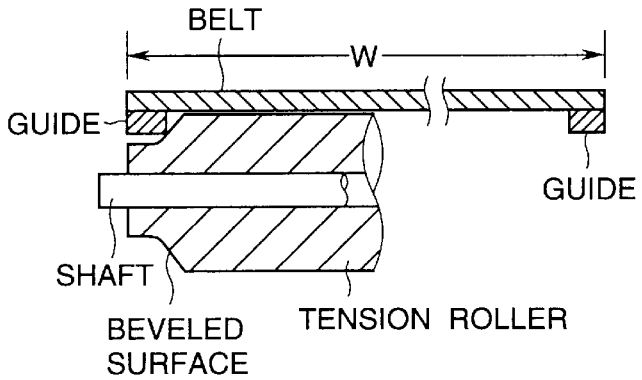
FIG.13A CONVENTIONAL ART
FIGS. 13A is a fragmentary cross-sectional view of a conventional belt unit.
Figure 13B:
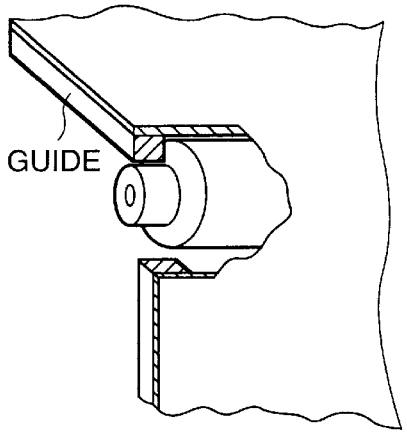
FIG.13B CONVENTIONAL ART
FIG. 13B is a fragmentary perspective view of the conventional belt unit of FIG. 13A.
Figure 13C:
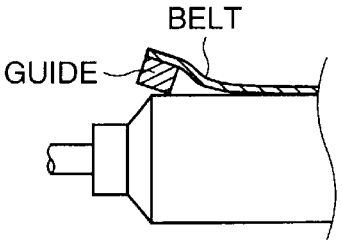
FIG.13C CONVENTIONAL ART
FIGS. 13C–13D are partially cross-sectional side views of the conventional belt unit of FIG. 14A.
Figure 13D:
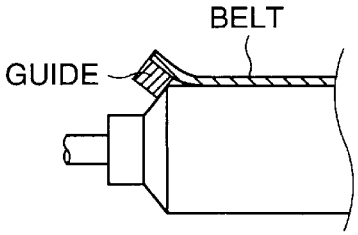
FIG.13D CONVENTIONAL ART

FIG. 12 is a perspective view of a belt unit according to a fourth embodiment.

Generally L-shaped tension arms 16L and 16R are mounted to the longitudinal ends of the driven roller 13 and are pivotal about a rotational shaft 13*a* of the driven roller 13. Each of the tension arms 16L and 16R has arms 16*a* and 16*b* which are at a right angle with each other. A tension roller 15 is rotatably supported on free end portions of the arms 16*a*. Flexible members such as wires 51L and 51R have one ends attached to free end portions of the arms 16*b* and the other ends mounted to ends of a tension spring 52. The tension spring 52 is positioned in a longitudinal direction substantially in the middle of the tension roller 15. The wires 51L and 51R are mounted about guide rollers 53L and 53R and held taut by the urging force of the spring 52.

The urging force of the spring 52 urges the tension roller 15 against the transport belt 11 so that the transport belt 11 runs under tension around the drive roller 12, driven roller 13, and tension roller 15.

If any one of the drive roller 12, driven roller 13, and idle roller 14 is not properly aligned in its position and direction of rotational axis with respect to the others, or the peripheral length of the transport belt 11 varies across the width W of the transport belt 11, the tension roller 15 tilts relative to the axis of the driven roller 13, accordingly.

Thus, the tension arm 16L and 16R on which the tension roller 15 is supported are at different angular positions with respect to the shaft 13*a*.

Since the tension arms 16L and 16R are coupled to the spring 52 via the wires 51L and 51R, the spring 52 stretches or contracts in accordance with the pivotal movement of the support members, i.e., the inclination of the tension roller 15 with respect to the driven roller 13.

For example, if the peripheral lengths of the lateral left half and right half of the transport belt are the same, the tension roller 15 rotates about an axis parallel to the drive roller 12. Thus, the spring 52 does not move relative to the driven roller 13.

If the peripheral length of the lateral left half of the transport belt is shorter than that of the lateral right half, the left end of the tension roller is at an inner side than the right end of the tension roller 15 so that the tension arms 16L and 16R are not at the same angular position. The transport belt 11 pushes the arm 16L to pivot in a direction shown by arrow M, so that the tension arm 16L pivots about the shaft 13*a* clockwise. As a result, the spring 52 stretches toward the guide roller 53L. Due to the fact that the spring 52 is connected to the wires 51R and 51L, the tension roller 15 applies the same urging force to the left and right halves of the transport belt 11.

A single spring 52 can provide urging forces to the tension arms 16L and 16R, allowing miniaturizing of the belt unit.

The guide rollers 53L and 53R allow changing of the direction of the urging force exerted by the spring 52, thus increasing the degree of freedom of the location of the spring 52, lending themselves to miniaturizing the belt unit.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A belt unit comprising:

a rotating drive member;

a rotating driven member;

an endless belt mounted about said drive member and said driven member, said endless belt running in a first direction when said drive member rotates;

a tension member which engages said belt to exert tension on said belt;

first and second support members which are pivotal independently of each other, said first and second support members loosely supporting said tension member therebetween;

at least one urging member which urges said tension member against said belt through said support members; and a coupling member which operatively couples said first support member and said second support member together so that said first and second support members transmit a same urging force of said urging member to said tension member.

2. The belt unit according to claim 1, wherein a first pivotal movement of one of said first and second support members causes a second pivotal movement of the other of said first and second support members, the first and second pivotal movements applying a substantially same urging force to said endless belt.

3. The belt unit according to claim 1, wherein said drive member, driven member, and tension member are rollers.

4. The belt unit according to claim 1, wherein said at least one urging member includes a first urging member which urges said first support member and a second urging member which urges said second support member; and wherein said coupling member is a rod having a first longitudinal end coupled to the first urging member and a second longitudinal end coupled to the second urging member, and the rod is pivotally supported substantially at a middle thereof.

5. The belt unit according to claim 1, wherein said coupling member includes an elongated member having a first longitudinal end portion which engages said first support member and a second longitudinal end portion which engages said second support member, the elongated member is pivotally supported substantially at a middle thereof and is movable relative to said first and second support members, and the elongated member is urged by said urging member against said first and second support members.

6. The belt unit according to claim 1, wherein said coupling member includes pivotally supported first and second elongated members having longitudinal ends which engage said first and second support members, respectively; and wherein said urging member is mounted across the first and second elongated members to urge the first and second elongated members toward each other so that the first and second elongated members urge said first and second support members.

7. The belt unit according to claim 1, wherein said coupling member includes a first flexible member connected to said first support member and a second flexible member connected to said second support member; and wherein said urging member is connected to the first and second flexible members so that said urging member pulls the first and second flexible members toward each other.

8. The belt unit according to claim 7, wherein the first and second flexible members are wires.

* * * * *